United States Patent [19]

Moren et al.

[11] 4,123,261

[45] Oct. 31, 1978

[54] TITANIUM-STABILIZED DEEP DRAWING STEEL SUITABLE FOR HOT GALVANIZING

[75] Inventors: Karl-Erik Moren; Par S. Sixtensson, both of Borlange, Sweden

[73] Assignee: Stora Kopparbergs Bergslags AB, Falun, Sweden

[21] Appl. No.: 839,417

[22] Filed: Oct. 5, 1977

[30] Foreign Application Priority Data

Oct. 21, 1976 [SE] Sweden ..... 7611673

[51] Int. Cl.[2] ..... C22C 38/42; C22C 38/50

[52] U.S. Cl. ..... 75/125; 75/128 T; 428/659

[58] Field of Search ..... 148/12 C, 36, 31.5; 75/125, 128 T; 428/659

[56] References Cited

U.S. PATENT DOCUMENTS

| | | | |
|---|---|---|---|
| 3,110,798 | 11/1963 | Keay, Jr. | 75/125 |
| 3,403,060 | 9/1968 | Ito et al. | 148/36 |
| 3,592,633 | 7/1971 | Osuka et al. | 75/125 |
| 3,814,646 | 6/1974 | Mould et al. | 148/12 C |
| 3,843,415 | 10/1974 | Leslie | 148/12 C |

OTHER PUBLICATIONS

Steel Products Manual; Stainless and Heat Resisting Steels, AISI 12/74, pp. 21, 22.

Stahhschlussel, 10th Ed., 1974 p.81(#105); p.83(#156, 157); p.107(#246); p.(#212); p.122(#56, 57).

*Primary Examiner*—Arthur J. Steiner

*Attorney, Agent, or Firm*—Watson, Cole, Grindle & Watson

[57] ABSTRACT

Titanium stabilized deep drawing steel containing from 0 to about 0.02 weight percent carbon, from 0 to about 0.04 weight percent manganese and from about 0.15 to about 0.3 weight percent titanium is rendered suitable for hot galvanizing by the inclusion therein of from about 0.03 to about 1.0 weight percent chromium, from about 0.02 to about 0.05 weight percent nickel and from about 0.04 to about 1.0 weight percent copper.

2 Claims, 5 Drawing Figures

TITANIUM-STABILIZED DEEP DRAWING STEEL SUITABLE FOR HOT GALVANIZING

BACKGROUND OF THE INVENTION

1. Field of the Invention

The present invention relates to cold rolled steel useful for deep drawing purposes and to the alloying of such steel with small quantities of copper, chromium and nickel whereby the adhesion between the steel surface and the zinc layer during hot galvanizing is improved.

2. Description of the Prior Art

A conventional steel suitable for deep drawing is described in SIS 141147 (Swedish Industrial Standard). In order to obtain the best properties for deep drawing, a cold rolled and coiled sheet or strip is annealed in a bell-type furnace or the like at a temperature of 650° to 700° C. for approximately 20 hours. Thereafter the sheet is temper rolled. The deep drawing suitability of a steel is a function of its "R-value" as fully described in published Swedish Patent Application Ser. No. 375,326. The above-described heat treated sheet of SIS 141147 steel generally has an R-value of about 1.5.

A conventional method for hot galvanizing comprises subjecting, in a continuous sequence, a cold rolled and coiled steel strip first to an annealing process in a furnace where the steel becomes soft and easy to handle and then to a galvanizing process. Then the steel strip is coiled again onto a capstan. After such treatment, heat treated sheets of SIS 141147 steel which before treatment had an R-value of about 1.5 are characterized by reduced deep drawing properties and often have an R-value of 1.0 or less.

Another known steel suitable for deep drawing contains small quantities of carbon and manganese, preferably not more than about 0.02 and 0.04 weight percent respectively, and an amount of titanium which generally should not exceed 0.4 weight percent. Generally such titanium-stabilized steels will contain from 0 to about 0.02 weight percent carbon, from 0 to about 0.04 weight percent manganese and from about 0.01 to about 0.4 weight percent titanium. Preferably, however, the titanium content should be in the range of from about 0.15 to about 0.3 weight percent. Unlike the heat treated SIS 141147 steel mentioned above, these latter steels retain their good deep drawing properties after hot galvanizing and it has been found that if the strip is passed in continuous sequence through an annealing furnace at 800° to 900° C., subsequently cooled to 450° to 500° C. and then passed through a hot galvanizing bath, the sheet will retain deep drawing properties corresponding to an R-value of 1.5 or greater.

When the heat treated SIS 141147 steel is hot galvanized, no substantial problems have been encountered in the adhering of the zinc to the surface of the sheet. On the other hand, when the latter described titanium alloy sheet is hot galvanized, it has been found that the rejection rate due to insufficient adhesion of the zinc is high.

SUMMARY OF THE INVENTION

In accordance with the present invention it has now surprisingly been found that the hot galvanizing properties of a titanium-stabilized steel are substantially improved by alloying therein small quantities of copper, chromium and nickel. Thus, the adhesion of the zinc to such titanium-stabilized steel during the hot galvanizing process is comparable to the adhesion experienced when heat treated SIS 141147 steel is hot galvanized.

In particular, the steel of the present invention comprises a titanium-stabilized deep drawing steel suitable for hot galvanizing and containing from about 0.02 to about 0.05 weight percent nickel, at least about 0.03 weight percent chromium and at least about 0.04 weight percent copper. Of course the copper content should be less than the amount that causes copper embrittlement or inferior drawing properties.

DESCRIPTION OF THE PREFERRED EMBODIMENT

In accordance with the present invention, a titanium-stabilized deep drawing steel suitable for hot galvanizing is provided by the inclusion therein of from about 0.02 to about 0.05 weight percent nickel, at least 0.03 weight percent chromium and at least about 0.04 weight percent copper. The copper content of course must be less than the amount that causes copper embrittlement or inferior drawing properties. When such titanium-stabilized deep drawing steel alloy is hot galvanized, it has been found that the zinc adhesion is very acceptable and rejections due to poor adhesion are reduced by at least 7 percent.

Figure 4:
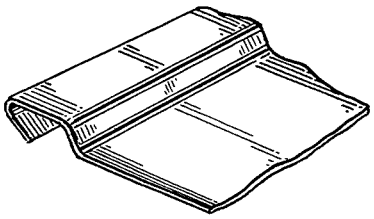
FIG. 4 is a perspective view showing the bent shape of a hot galvanized steel sample which has been bent to test for zinc adhesion.
Figure 5:
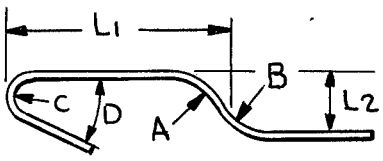
FIG. 5 is a cross-sectional view of the bent sample of FIG. 4. In this FIG., Radii A and B are each 2 mm, Radius C is 1.5 mm, angle D is 40°, length $L_1$ is 10 mm and length $L_2$ is 4 mm.

In order to compare the zinc adhesion of hot galvanized steel samples that embody the invention with hot galvanized steel samples that do not, samples of hot galvanized steels containing various quantities of nickel, chromium and copper were obtained by cutting a sheet transversely of the rolling direction. A bend in accordance with FIGS. 4 and 5 was made in each sample along its cut edge. The bends thus extended transversely of the rolling direction. By this arrangement it is possible to test the zinc adhesion both at the side edges and in the central portions of the sheet.

After bending, the surface adjacent the bend is inspected visually to determine the adherence of the zinc layer to the sheet surface and particularly the extent of flaking if any. The results are classified according to a scale with 5 grades where 1 stands for "no objection" and 5 stands for "notable flaking".

The samples were prepared by alloying different quantities of copper, chromium and nickel into 101 separate charges of titanium stabilized steel, each containing from 0 to about 0.02 weight percent carbon, from 0 to about 0.04 weight percent manganese and from about 0.15 to about 0.3 weight percent titanium, the remainder of course being iron and the usual impurities. 144 hot galvanized sheet strip samples were prepared from these charges and subjected to the bending test described above. The samples were then thoroughly examined visually for zinc adhesion and the extent of flaking and each sample was assigned a grade as described above.

Figure 1:
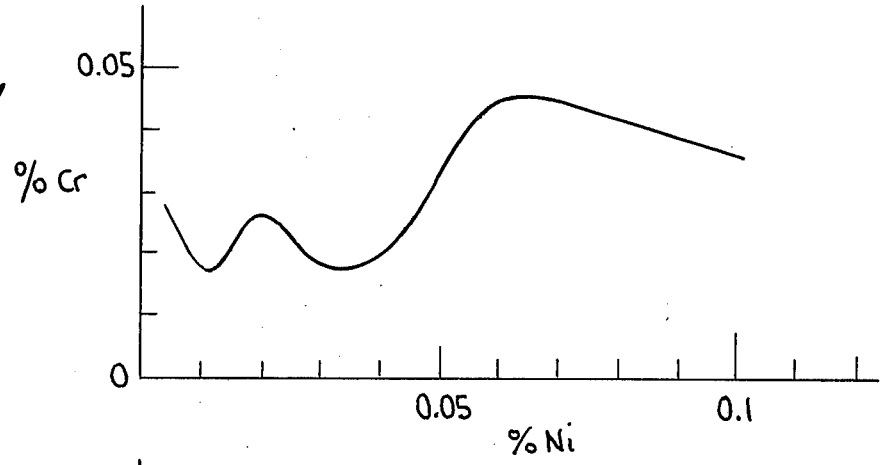
FIG. 1 is a graphical presentation of empirical data obtained by testing hot galvanized titanium-stabilized steel samples having known nickel, chromium and copper contents for zinc adhesion. The curve is presented on a graph which coordinates nickel content in percent by weight plotted along the abcissa against chromium content in percent by weight plotted along the ordinate and the curve is placed such that the coodinates of steel samples having acceptable zinc adhesion characteristics are located thereabove.
Figure 2:
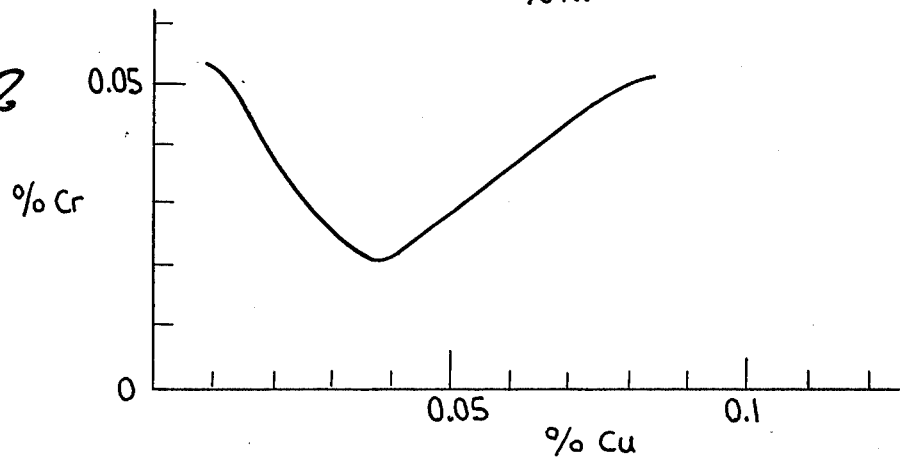
FIG. 2 is a graphical presentation similar to FIG. 1 except that in this case copper content in percent by weight is plotted along the abcissa.
Figure 3:
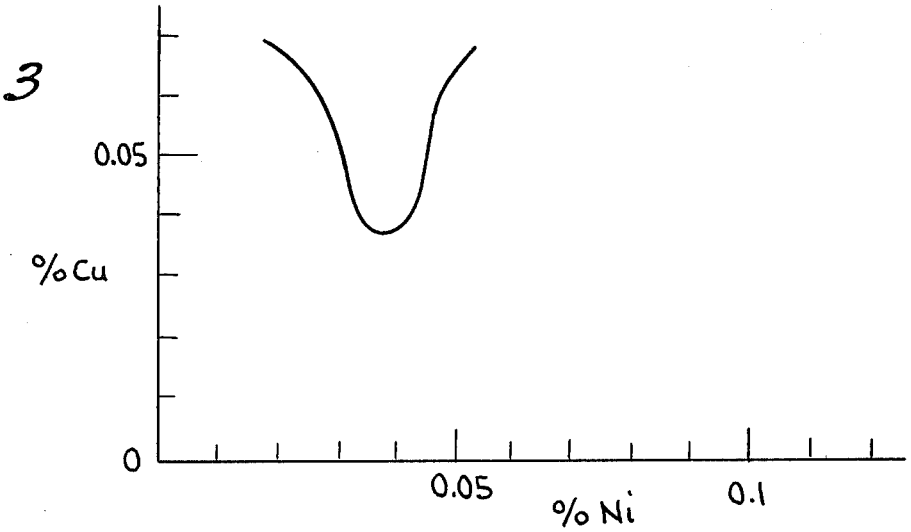
FIG. 3 is a graphical presentation similar to FIG. 1 except that in this case copper content in percent by weight is plotted along the ordinate.

FIGS. 1, 2 and 3 are arranged with the added alloy components plotted in weight percent on the abcissa and ordinate respectively. The three curves are placed on the graph in such a way that the coordinates of all samples having acceptable zinc adhesion characteristic are located in the area above the curves while the coordinates of unacceptable samples are located below the curves. Generally, only the grade 1 samples are considered to have acceptable zinc adhesion characteristics in the preparation of these curves. However, in a few instances the coordinates of grade 2 samples are located above the curves, but these in number do not exceed 10 percent of the grade 1 samples.

In FIGS. 1 and 3, the samples having coordinates above the curve each have a nickel content within the range of from about 0.02 to about 0.05 weight percent.

In FIGS. 1 and 2, the samples having coordinates above the curve each have a chromium content which is at least about 0.03 weight percent. In FIGS. 2 and 3, the samples having coordinates above the curve each have a copper content which is at least about 0.04 weight percent.

Preferably, the chromium content should be no greater than about 1.0 weight percent since no further improvement of zinc adhesion characteristics is to be expected above this limit. The copper content also is preferably limited to about 1.0 weight percent at the most since above this value there is a risk of copper precipitation at the grain boundaries thus producing copper embrittlement. Moreover, above this value copper may precipitate in the matrix thus producing a harder material having inferior drawing properties.

We claim:

1. A titanium-stabilized deep drawing steel suitable for hot galvanizing which contains up to about 0.02 weight percent carbon, up to about 0.04 weight percent manganese, from about 0.01 to about 0.4 weight percent titanium, from about 0.04 to about 1.0 weight percent chromium, from about 0.04 to about 1.0 weight percent copper, and about 0.02 to about 0.05 weight percent nickel.

2. A steel as set forth in claim 1 which contains from about 0.15 to about 0.3 weight percent titanium.

* * * * *